US011098567B2

(12) United States Patent
Snider et al.

(10) Patent No.: US 11,098,567 B2
(45) Date of Patent: Aug. 24, 2021

(54) WELL COMPLETION METHOD

(71) Applicant: GEODYNAMICS, INC., Millsap, TX (US)

(72) Inventors: Philip M. Snider, Houston, TX (US); David S. Wesson, Ft. Worth, TX (US); Steve Baumgartner, Houston, TX (US); John T. Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 16/816,743

(22) Filed: Mar. 12, 2020

(65) Prior Publication Data

US 2020/0300072 A1 Sep. 24, 2020

Related U.S. Application Data

(60) Provisional application No. 62/819,948, filed on Mar. 18, 2019.

(51) Int. Cl.

| | |
|---|---|
| ***E21B 43/26*** | (2006.01) |
| ***E21B 33/12*** | (2006.01) |
| ***E21B 43/117*** | (2006.01) |

(52) U.S. Cl.
CPC ..... *E21B 43/26* (2013.01); *E21B 33/12* (2013.01); *E21B 43/117* (2013.01)

(58) Field of Classification Search
CPC ..... E21B 43/26; E21B 33/12; E21B 43/117; E21B 43/119
See application file for complete search history.

(56) References Cited

U.S. PATENT DOCUMENTS

| | | | | |
|---|---|---|---|---|
| 5,273,115 | A * | 12/1993 | Spafford | E21B 43/261 166/281 |
| 2015/0144347 | A1* | 5/2015 | Brannon | E21B 43/26 166/308.1 |
| 2018/0245440 | A1* | 8/2018 | Entchev | E21B 43/162 |

* cited by examiner

*Primary Examiner* — James G Sayre
(74) *Attorney, Agent, or Firm* — Patent Portfolio Builders PLLC

(57) ABSTRACT

A method for fracturing a well casing includes forming plural perforation clusters into a stage N associated with the well casing; fracturing the plural perforation clusters; forming a current stage N+1 by placing a plug within the stage N, to isolate a first subset of the plural perforation clusters from a second subset of the plural perforation clusters; and fracturing a second time the second subset, but not the first subset.

20 Claims, 17 Drawing Sheets

WELL COMPLETION METHOD

BACKGROUND

Technical Field

Embodiments of the subject matter disclosed herein generally relate to a well completion process that involves perforating and/or fracturing operations associated with various stages of the well, and more specifically, to a process in which one or more stages of the well are perforated and/or fractured more than once so that two stages are overlapped.

Discussion of the Background

After an oil and gas well 100 is drilled to a desired depth H relative to the surface 110, as illustrated in FIG. 1, and the casing 102 protecting the wellbore 104 has been installed and cemented in place, it is necessary to connect the wellbore 104 to the subterranean formation(s) 106 outside the well to extract the oil and/or gas. This process of connecting the wellbore to the subterranean formation may include a step of isolating a stage 130 of the casing 102 from a previous stage 132, for example, with a plug 112, a step of perforating the casing 102 for the stage 130 with a perforating gun assembly 114 such that various channels 116 are formed to connect the subterranean formations to the inside of the casing 102, a step of removing the perforating gun assembly as illustrated in FIG. 2, and a step of fracturing the various channels 116 associated with the stage 130.

Some of these steps require to lower into the well 100 a wireline 118 or equivalent tool, which is electrically and mechanically connected to the perforating gun assembly 114, and to activate the gun assembly and/or a setting tool 120 attached to the perforating gun assembly. Setting tool 120 is configured to hold the plug 112 prior to isolating a stage and also to set the plug. FIG. 1 shows the setting tool 120 disconnected from the plug 112, indicating that the plug has been set inside the casing.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating and/or fracturing the casing at multiple locations, corresponding to different stages 130, 132, etc. of the well. Note that in this case, multiple plugs 112 and 112' may be used for isolating the respective stages from each other during the perforating phase and/or fracturing phase.

These completion operations may require several plugs run in series or several different plug types run in series. For example, within a given completion and/or production activity, the well may require several hundred plugs depending on the productivity, depths, and geophysics of each well. Subsequently, production of hydrocarbons from these zones requires that the sequentially set plugs be removed from the well. In order to reestablish flow past the existing plugs, an operator must remove and/or destroy the plugs by milling or drilling the plugs.

No matter how many plugs are used for separating each stage from a previous one, as shown in FIG. 2, at no time a given stage 130 extends into a previous stage 132. In other words, after the stage 132 was perforated and the corresponding channels 117 have been established and fractured, the next stage 130 is configured to not overlap with the previous stage. In other words, the current wells create discrete stages 130, 132, where the fracture treatment is pumped into each stage independent of the other stage or stages. Then, the current stage 132 is sealed off with the plug 112, which is set somewhere above the treated stage 132, and the next stage 130 is perforated and then pumped with no interaction between stages 130 and 132 within the well casing 102, although the stages 130 and 132 may interact unpredictably, outside of the well casing, as shown by element 119 in FIG. 2, which shows that a given channel 117' from the stage 132 communicates with a given channel 116' from the stage 130.

Assuming good communication between each of the perforation clusters 140, 142 and the formation 106, the placement of fluid 124 within the stage may be uniform, i.e., the same amount of fluid 124 is pumped through each cluster 140, 142. A perforation cluster or cluster is understood herein to include perforation holes made with a cluster of shaped charges of a gun, into the well 102, to communicate a stage with the corresponding formation. Even if the placement of the fluid 124 into the formation is uniform through the clusters 140, 142, the conditions at the heel-ward (or uphole) cluster 140 are different from the conditions at the more toe-ward cluster 142, and the transport of the proppant material in the fluid 124 will not be the same. Note that the terms "heel-ward" and "toe-ward" herein are used with regard to the heel portion 102A and the toe region 102B of the well 102.

Further, the perforation holes in each cluster are subject to erosion as a function of time and the total proppant flow. Clusters with eroded perforations will take more fluid (and proppant) accelerating the effect, unless and until a more heel-ward cluster reduces the amount of fluid and proppant that the cluster is taking, by opportunistically taking the fluid first and reducing the available velocity and pressure. These conditions combine to produce clusters where the dominant treatment zone is often situated in the toe-ward clusters 142 of a stage, leaving the heel-ward clusters 140 relatively untreated. The reverse is also possible.

Diverters (chemical, conveyed solid, or perforation hole sized objects) are sometimes used to divert the flow from the dominant clusters to the less dominant clusters, with unknown effect. Once plug 112 is set, the heel-ward clusters 144 of the stage 132 are stranded and will never be properly treated, even after new perforation clusters 140, 142 are created and treated in the next stage 130.

Thus, the current fracturing methods fail to uniformly distribute the proppant material into the existing perforation clusters. For this reason, there is a need for a new perforation process that prevents such imbalanced proppant material within a given stage.

BRIEF SUMMARY OF THE INVENTION

According to an embodiment, there is a method for fracturing a well casing and the method includes forming plural perforation clusters into a stage N associated with the well casing; fracturing the plural perforation clusters; forming a current stage N+1 by placing a plug within the stage N, to isolate a first subset of the plural perforation clusters from a second subset of the plural perforation clusters; and fracturing a second time the second subset, but not the first subset.

According to another embodiment, there is a method for fracturing a well that includes pumping a given fluid through plural perforation clusters formed into a stage N, which is associated with a first portion of a well casing; setting up a plug within the stage N, to close a bore of the well casing, so that a first subset of the plural perforation clusters is fluidly sealed off from a second subset of the plural perforation clusters; and pumping again the given fluid only through the second subset, but not through the first subset.

According to still another embodiment, there is a method for fracturing a well, and the method includes selecting a stage N that extends over a first portion of a well casing; perforating and fracturing the stage N; selecting a new stage N+1 that extends over a second portion of the well casing; and perforating and fracturing the stage N+1, where the first portion overlaps with the second portion and perforation holes made into the overlapped portion are fractured with a given fluid during the perforating and fracturing of the stage N and also during the perforating and fracturing of the stage N+1.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to an oil and gas well having plural stages. However, the embodiments to be discussed next are not limited to an oil and gas well, but they may be applied to other types of wells.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a novel perf and frac method is introduced and this method is directed to a new type of staged unconventional well, where some of the stages may overlap. To overlap the stages, a plug for a subsequent stage may be positioned lower than at least one of the most heel-ward cluster of the previous stage, i.e., within that previous stage. The subsequent stage may be perforated so that the new perforation clusters are made only in the new part of the stage. However, in one application, it is possible to add perforation clusters in the overlap portion of the clusters or only in the previous stage. In one embodiment, the number of overlap stages can vary from two to the total number of stages. In other words, in a given well, it is possible to simultaneously have conventional and overlapped stages in any ratio and in any order. Various modifications to these steps may be implemented, as discussed later.

Figure 1:
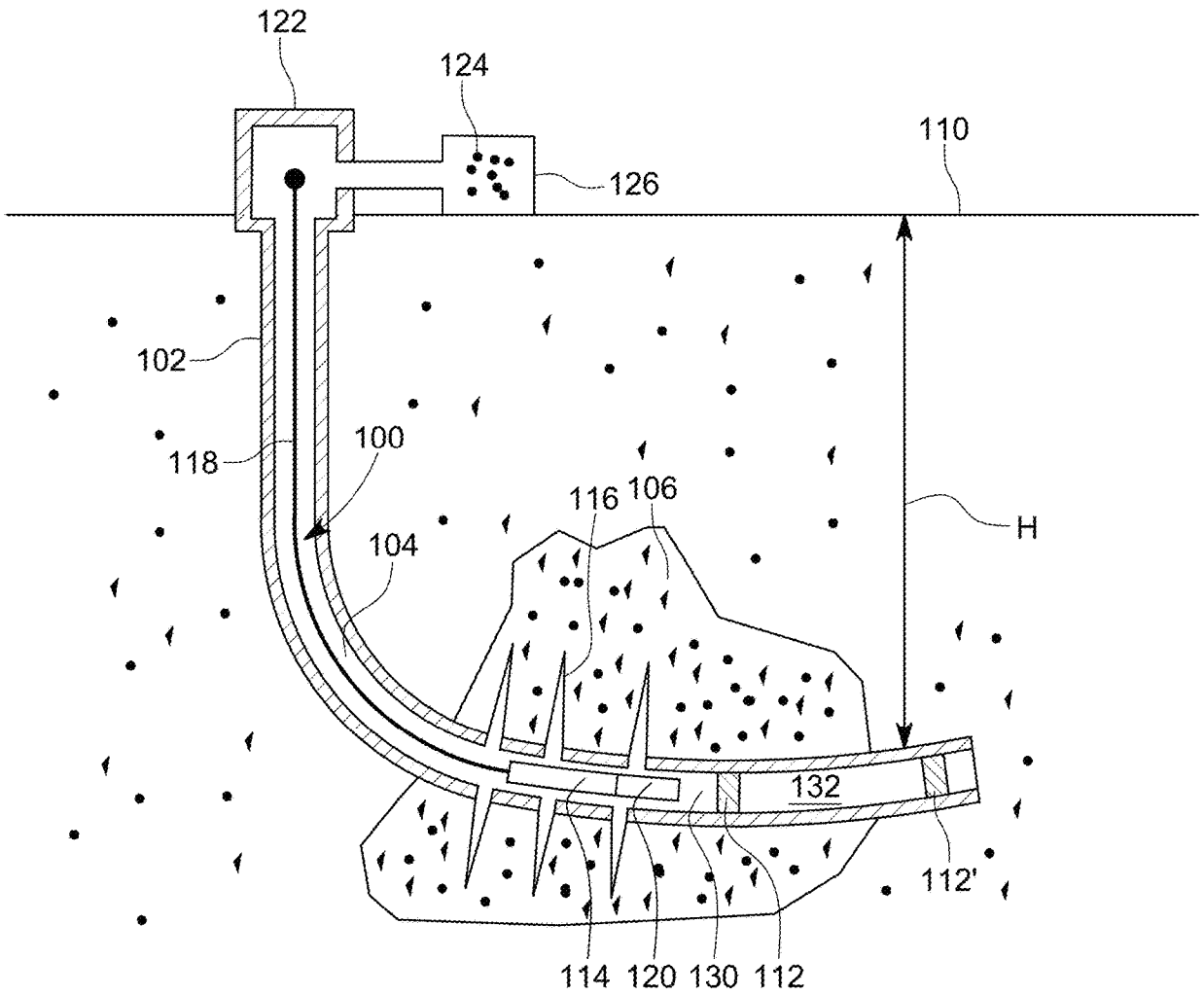
FIG. 1 (BACKGROUND ART)
FIG. 1 is a schematic diagram of a well in which a setting tool and a plug have been deployed.
Figure 2:
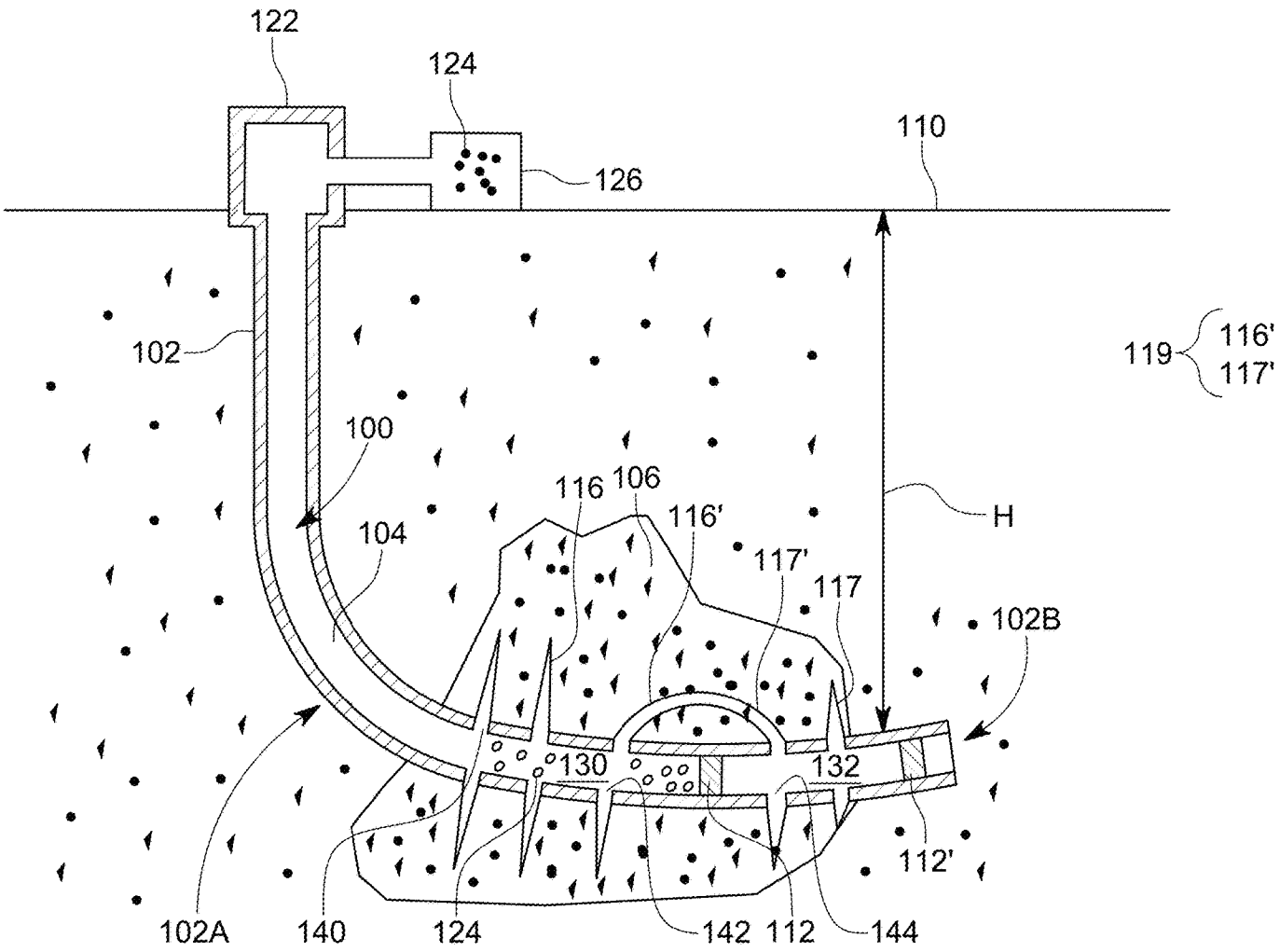
FIG. 2 (BACKGROUND ART)
FIG. 2 is a schematic diagram of a fracturing operation of a new stage after a previous stage has been fully sealed.
Figure 3:
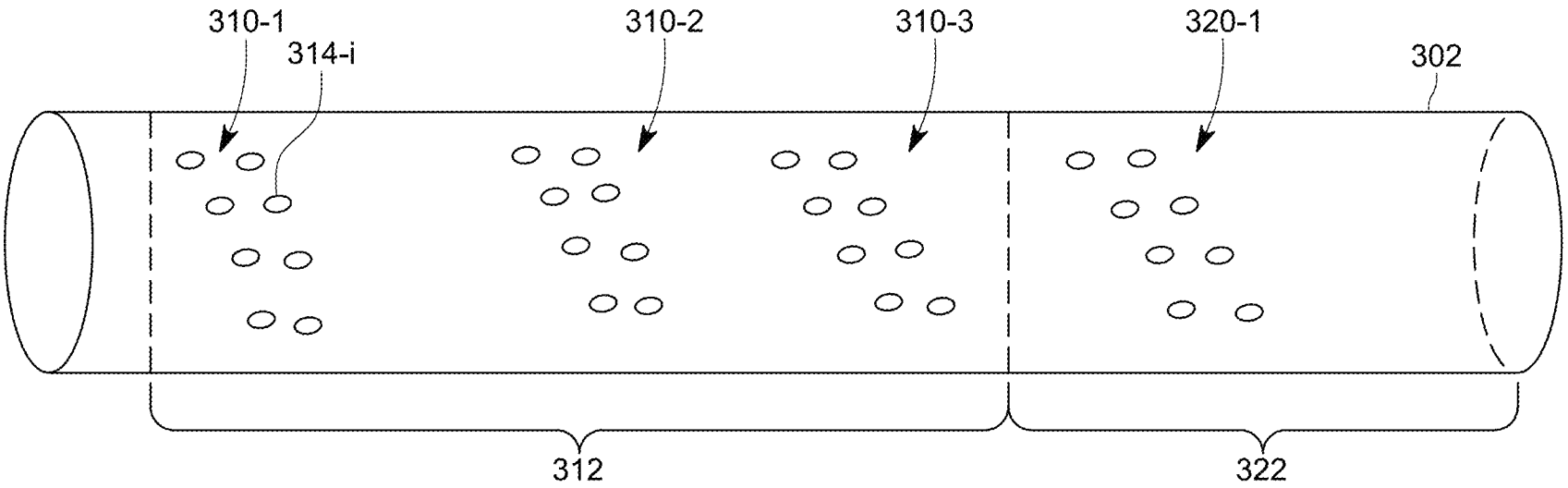
FIG. 3 illustrates plural perforation clusters formed into the casing of a well.

Prior to discussing the new method, some definitions related to the perforation clusters are believed to be in order. FIG. 3 shows a portion of a well casing 302 that was fractured with one or more guns (not shown). Perforation clusters 310-1 to 310-3 are shown as being made in the well casing for a given stage 312. An adjacent stage 322, has its own perforation clusters 320-1 (only one shown for simplicity). Each cluster 310-1, 310-2, 310-3, 320-1 . . . includes one or more holes 314-*i*. Each hole corresponds to a shaped charge that is distributed on the perforating gun. Although FIG. 3 shows the stage 312 having three perforation clusters, a stage may include any number of perforation clusters and a cluster may include any number of holes.

Figure 4A:
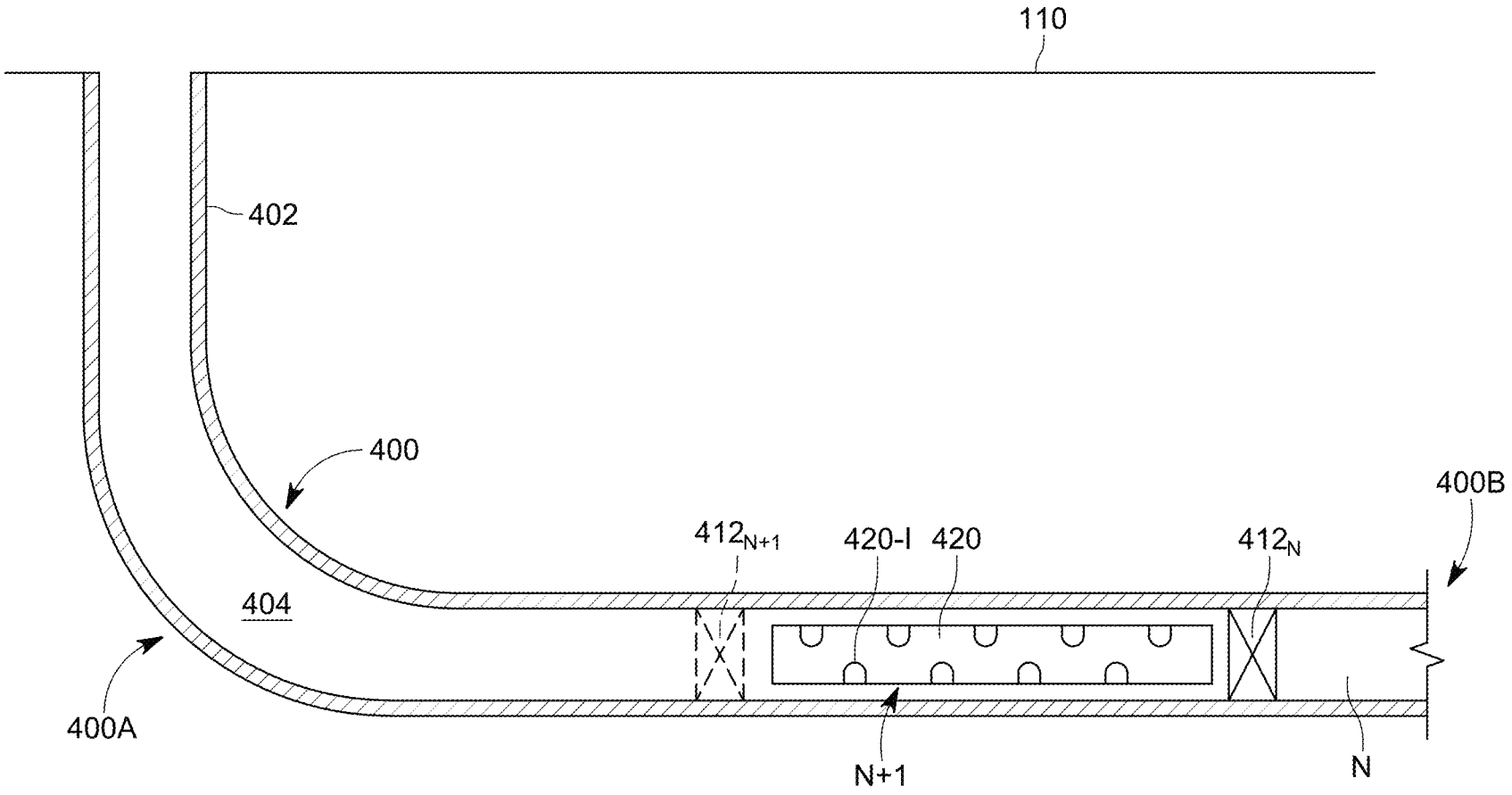
FIGS. 4A to 4G illustrate the perf and frac operations performed on multiple stages so that two adjacent stages N and N+1 are overlapped.
Figure 4B:
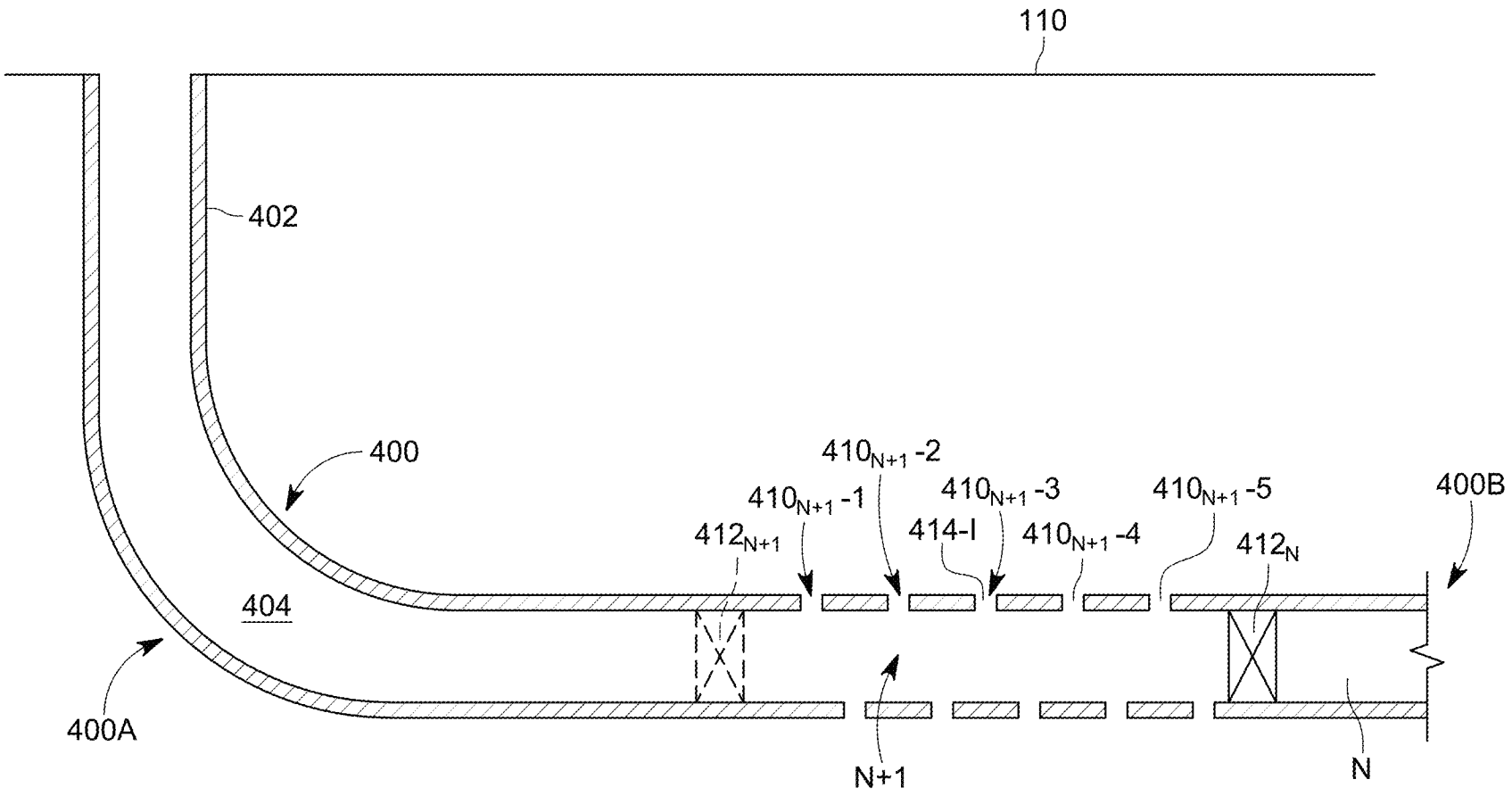
Figure 4C:
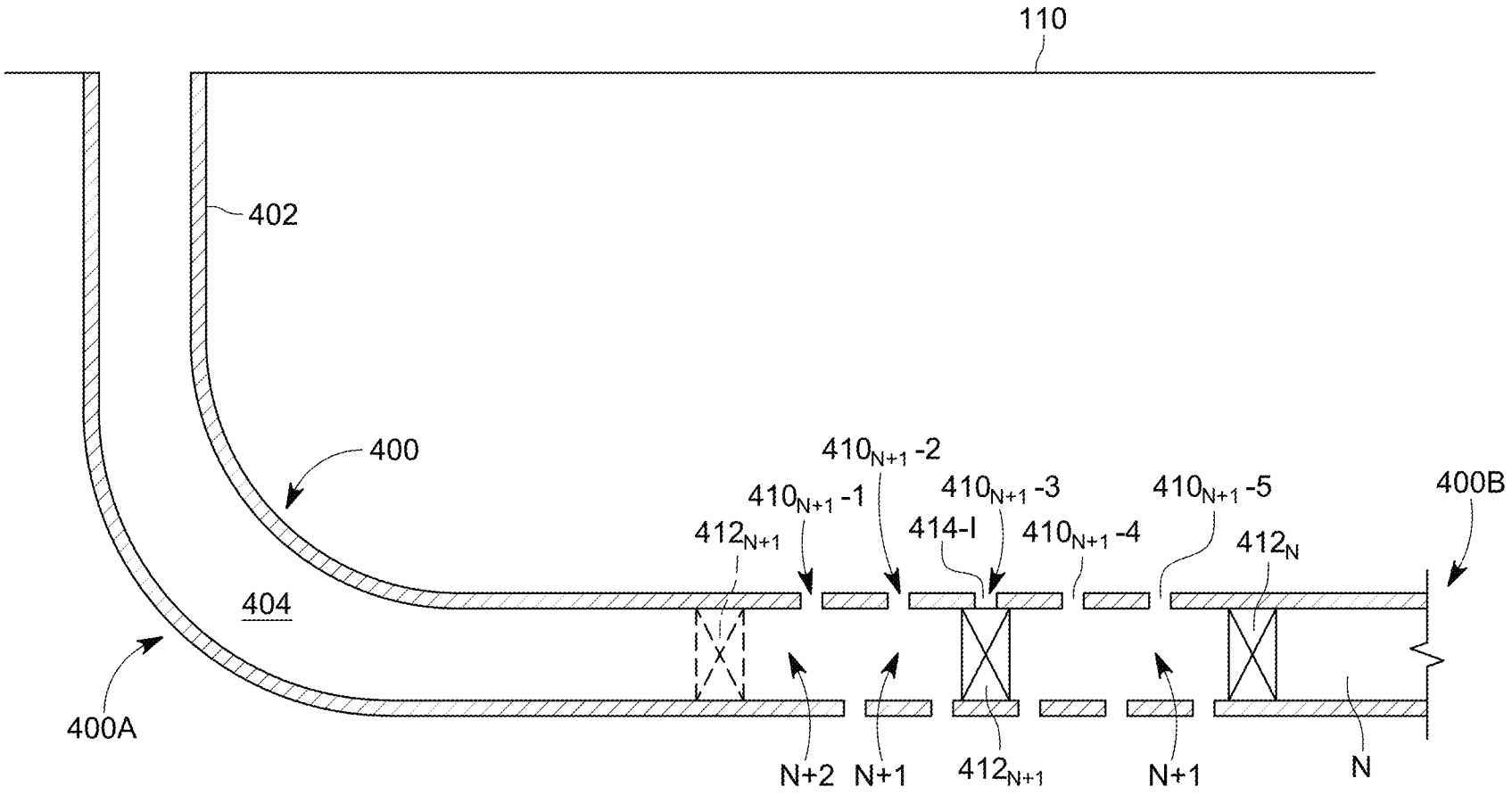

With these clarifications in mind, an embodiment of the novel perf and frac process is now discussed with regard to FIGS. 4A-4C. The well 400 in FIG. 4A is a horizontal well, having a heel portion 400A and a toe portion 400B. The casing 402 has plural stages, only two of which are shown as stage N and stage N+1. Stage N is considered to have been perforated (not shown) and fractured, after which a plug $\mathbf{412}_N$ has been placed in the bore 404 to seal off the stage N.

A gun 420 is then lowered into the bore 404 and shaped charges 420-I, which are distributed around the gun, are shot to generate the perforation clusters $\mathbf{410}_{N+1}$-1, $\mathbf{410}_{N+1}$-2, $\mathbf{410}_{N+1}$-3, $\mathbf{410}_{N+1}$-4, $\mathbf{410}_{N+1}$-5, etc., each cluster having perforations 414-I, as illustrated in FIG. 4B. Note that FIG. 4B shows the gun 420 removed from the well. A next plug $\mathbf{412}_{N+1}$ would traditionally be placed upstream of the most heel-ward cluster $\mathbf{410}_{N+1}$-1, to seal off the current stage N+1.

However, the next plug $\mathbf{412}_{N+1}$ is not placed at the location suggested in FIG. 4B (for this reason, the plug is represented with a dashed line), but in fact the plug is located within the stage N+1, as illustrated in FIG. 4C. Note that the heel-ward perforation clusters $\mathbf{410}_{N+1}$-1 and $\mathbf{410}_{N+1}$-2 of the stage N+1 will now be part of the next stage N+2 while the toe-ward perforation clusters $\mathbf{410}_{N+1}$-4 and $\mathbf{410}_{N+1}$-5 remain sealed behind the plug $\mathbf{412}_{N+1}$. In one variation of this embodiment, it is possible to place the plug $\mathbf{412}_{N+1}$ to actually also seal one or more holes 414-I of the perforation cluster $\mathbf{410}_{N+1}$-3. Note that it is also possible that the plug does not seal any hole of any perforation cluster.

Figure 4D:
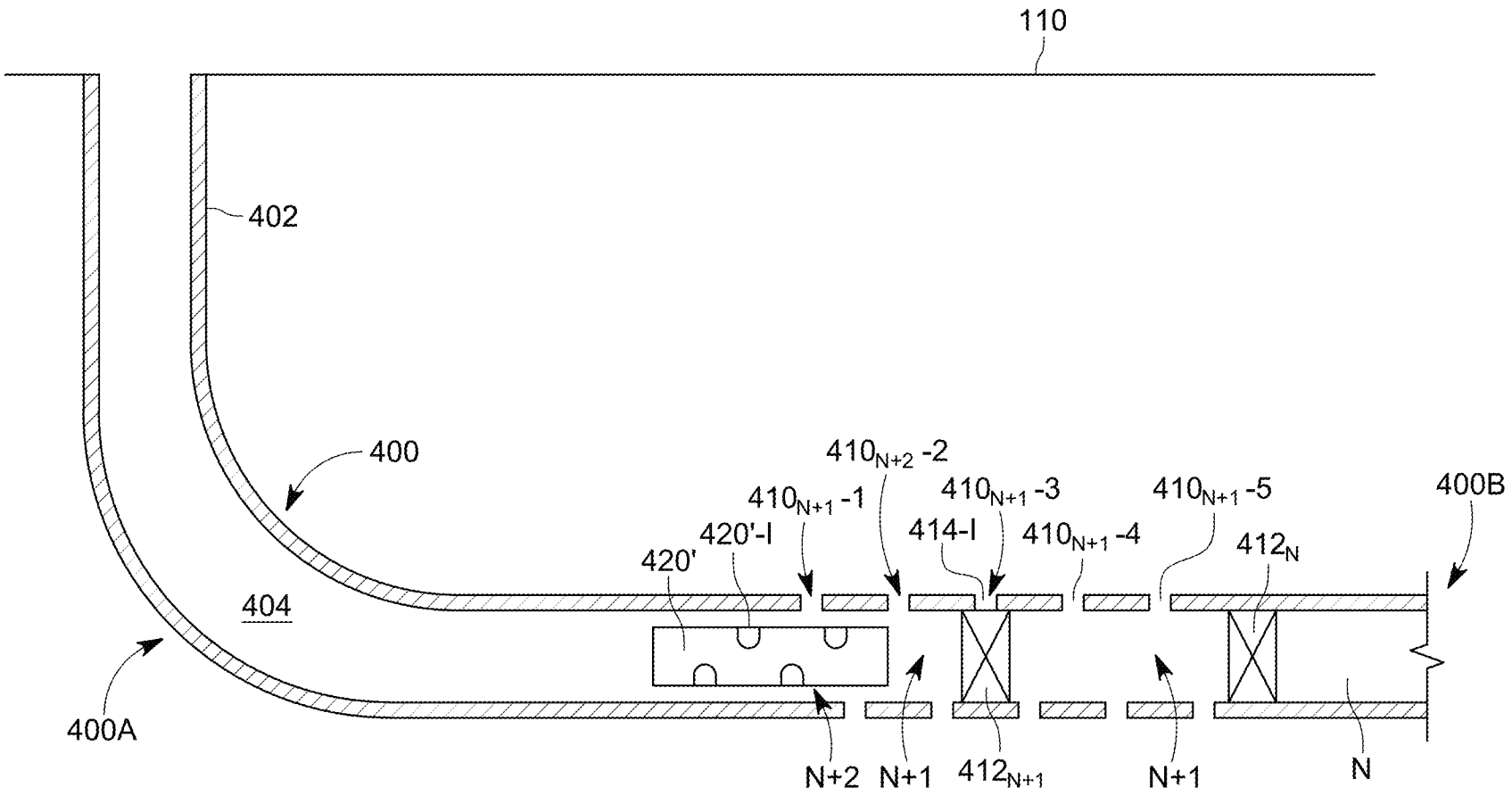
Figure 4E:
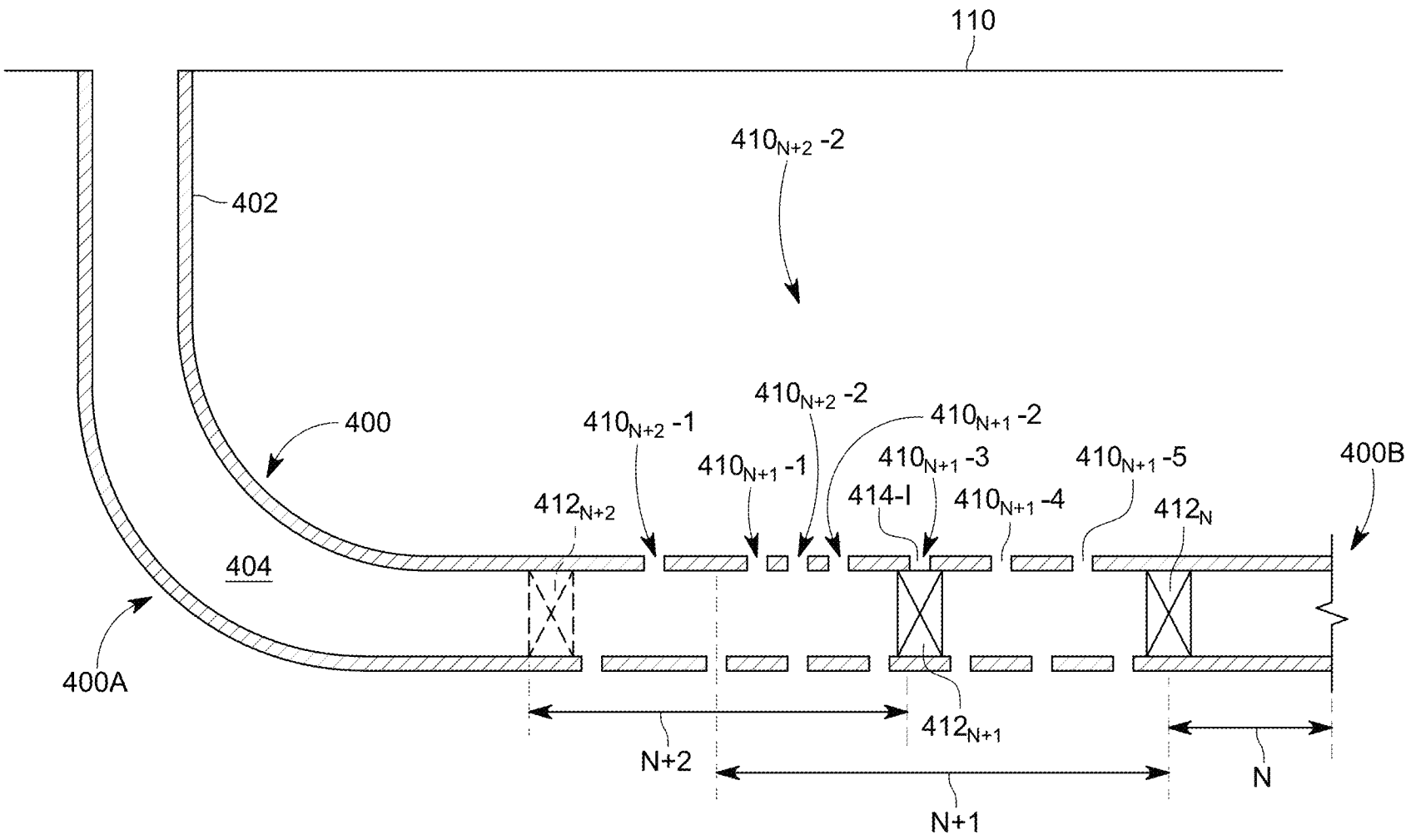
Figure 4F:
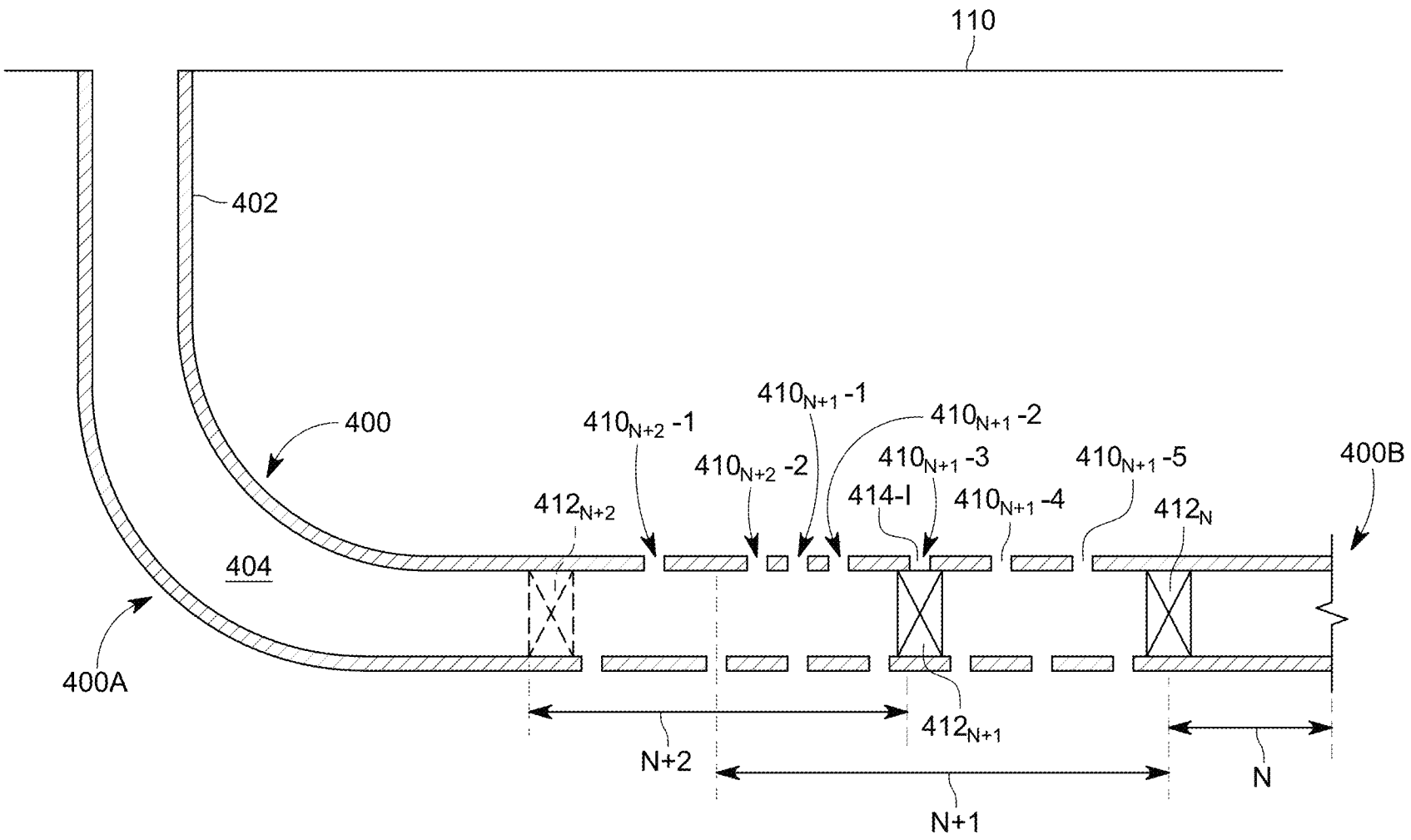
Figure 4G:
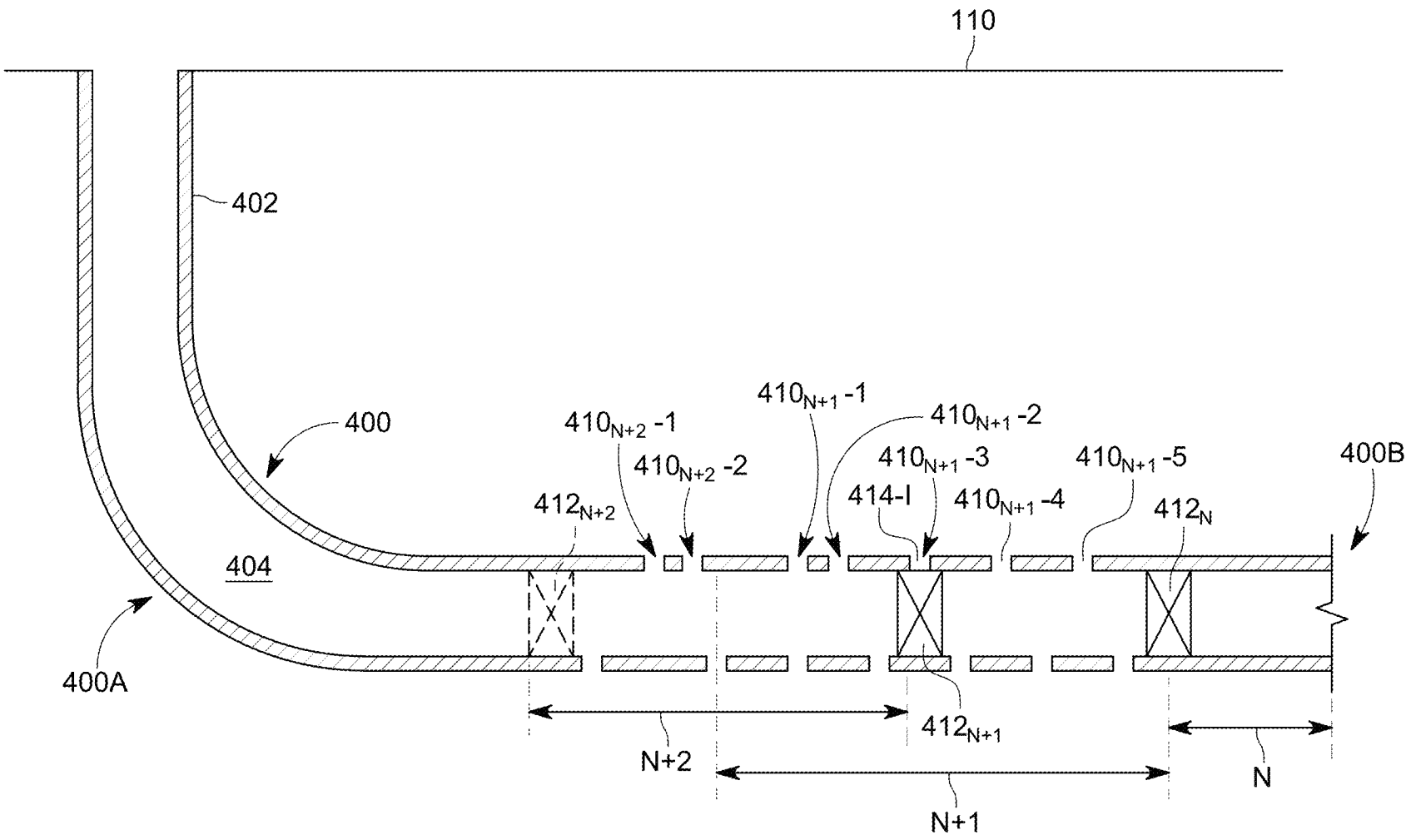

FIG. 4D shows another gun 420' being lowered into the bore 404 and corresponding shaped charges 420'-I are detonated to make new perforation clusters $\mathbf{410}_{N+2}$-1 and $\mathbf{410}_{N+2}$-2, as shown in FIG. 4E. The new perforation clusters may be located within the original stage N+1 (see, for example, perforation cluster $\mathbf{410}_{N+2}$-2 being made within the original stage N+1) and/or outside the original stage N+1 (see, for example, perforation cluster 410$_{N+2}$-1). In one embodiment, the perforation cluster 410$_{N+2}$-2 of the current stage N+2 is made between perforation clusters 410$_{N+1}$-1 and 410$_{N+1}$-2 of the previous stage N+1, as shown in FIG. 4E. In still another embodiment, the most toe-ward perforation cluster 410$_{N+2}$-2 of the N+2 stage is made upstream of the most heel-ward perforation cluster 410$_{N+1}$-1 of the N+1 stage, as shown in FIG. 4F. Note that in this embodiment, the most toe-ward perforation cluster 410$_{N+2}$-2 of the N+2 stage is also located in the N+1 stage. In yet another embodiment, as illustrated in FIG. 4G, the most toe-ward perforation cluster 410$_{N+2}$-2 of the N+2 stage is made outside of the N+1 stage. In still another embodiment, one or more of the perforation clusters of the N+2 stage are made to coincide with one or more of the perforation clusters of the N+1 stage.

After the perforation clusters are made for the N+2 stage, and the fracturing operation is completed, a corresponding plug 412$_{N+2}$ is placed in the bore 404 to seal off the N+2 stage. The plug may be placed at an end of the stage N+2, as traditionally planned, or within the N+2 stage, according to an embodiment. This process can continue for the next stage N+3, with one or more of the perforation clusters made to overlap with the stage N+2 if the corresponding plug 412$_{N+2}$ is placed within the stage N+2. In one embodiment, the corresponding plug 412$_{N+2}$ is placed to not overlap the stages N+2 and N+3. Those skilled in the art, with the benefit of this disclosure, will understand that each new stage may be made to overlap or not with a previous stage. In one embodiment, it is possible to make a new stage to overlap with more than one previous stage. In this regard, note that a length of a stage along a longitudinal axis of the well may be in the orders of meters to tens of meters to hundreds of meters. For example, if a stage N is about 10 m, then the next stage N+1 may be made to overlap for 9 m with the stage N, and the next stage N+2 may be made to overlap for 9 m with the stage N+1 and for 8 m with the stage N, and so on. Further, the perforation clusters in a new stage N+1, that overlaps with the previous stage N, may be made to be interspersed with the perforation clusters of the previous stage, to partially overlap with the perforation clusters of the previous stage, or to be fully upstream of the perforation clusters of the previous stage.

Figure 5A:
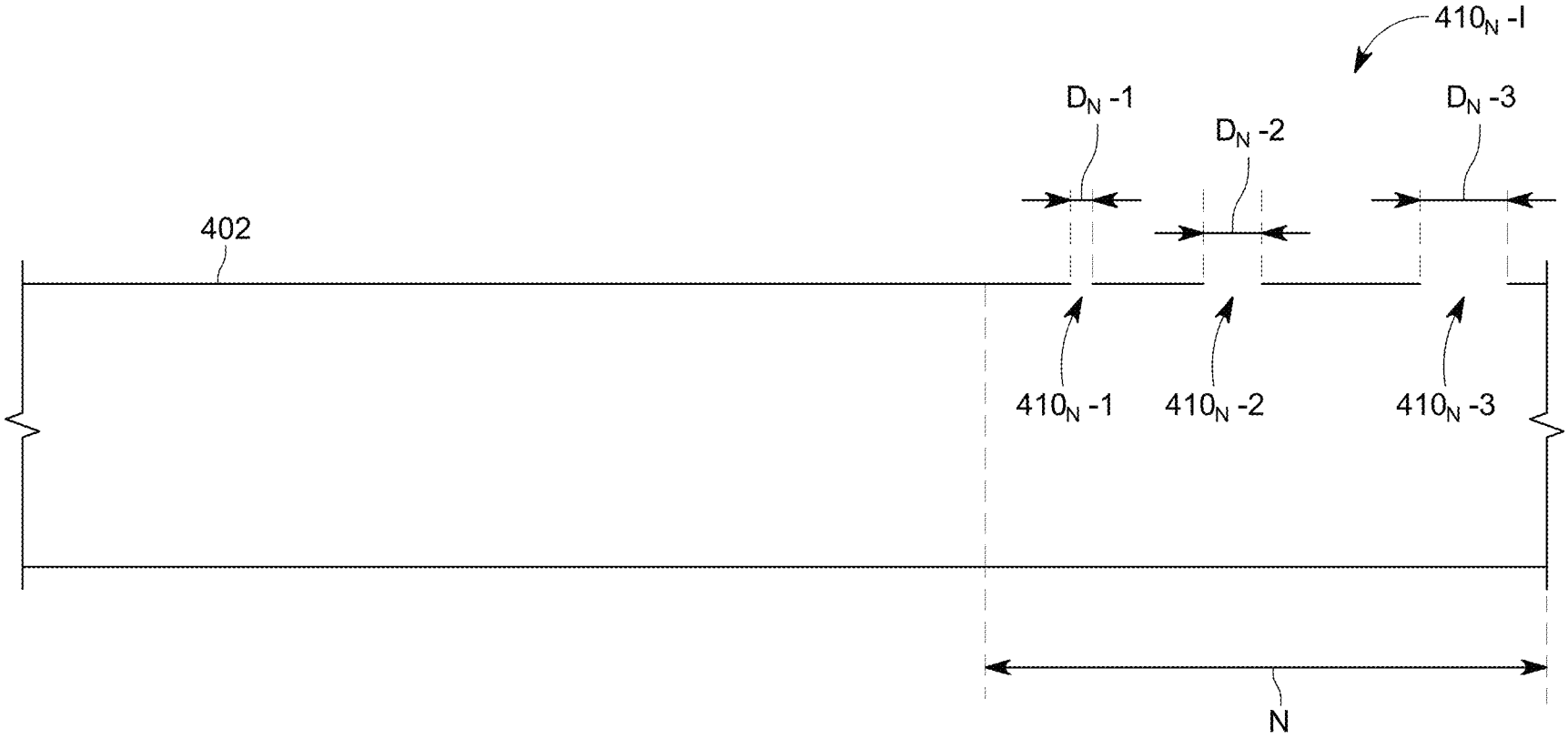
FIGS. 5A to 5C illustrate how the diameter of the plural perforation clusters from overlapped stages changes with the frac operations.

With this novel configuration of overlapped stages, the following problem that might be encountered in the well may be solved. FIG. 5A shows an casing 402 that was perforated to form a stage N, and this stage has perforation clusters 410$_N$-1 to 410$_N$-3, which are generically referred to as 410$_N$-I. Even if initially the holes of the perforation clusters were made to be equal, after a certain time of fracturing, due to the erosion experienced by the holes due to the proppant material that is pushed out of the casing, the diameter of the holes of some perforation clusters may become larger than the diameter of other perforation clusters. FIG. 5A illustrates the diameter $D_N$-3 of the perforation cluster 410$_N$-3 being the largest, the diameter $D_N$-2 of the perforation cluster 410$_N$-2 being the next larger, and the diameter $D_N$-1 of the perforation cluster 410$_N$-1 being the smallest.

Figure 5B:
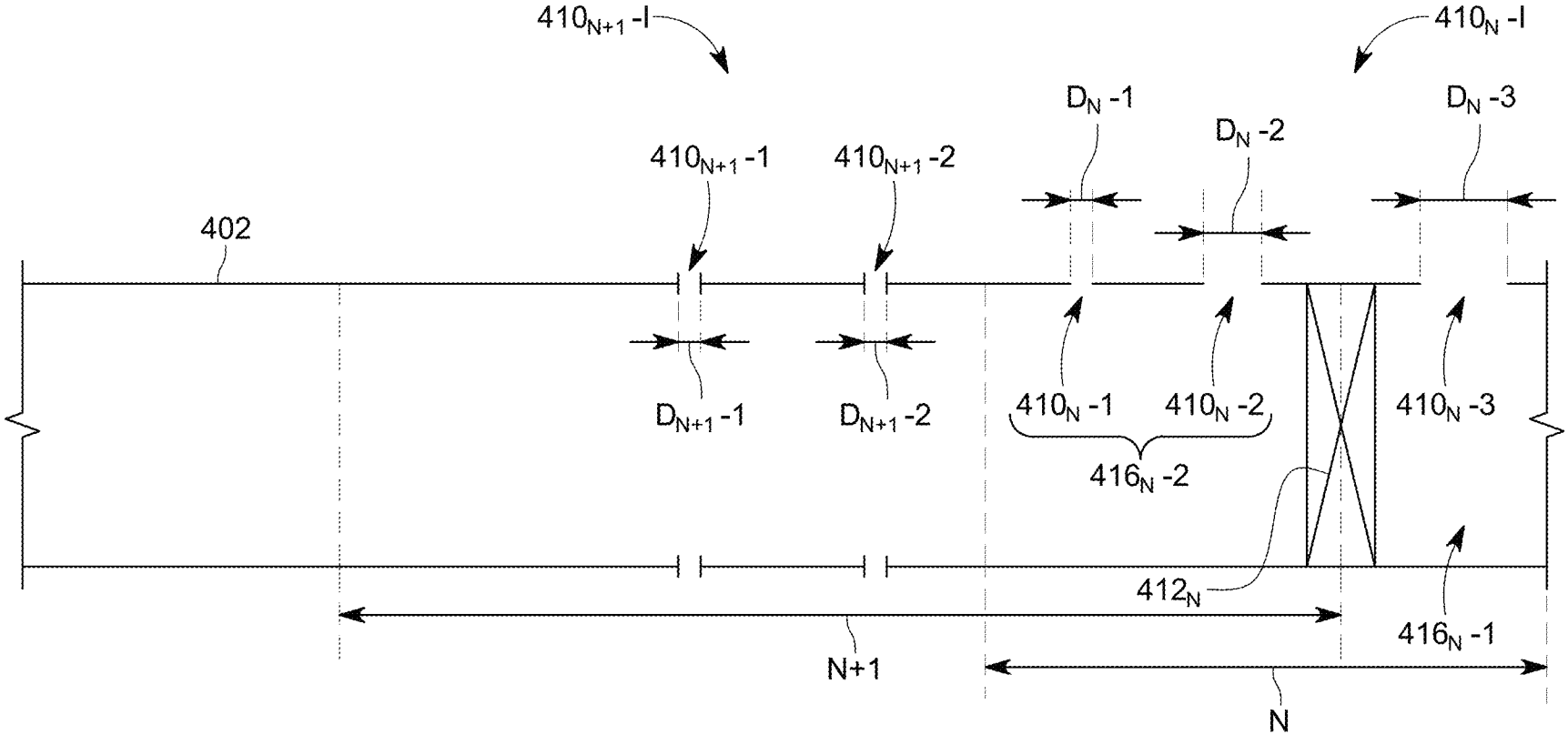
Figure 5C:
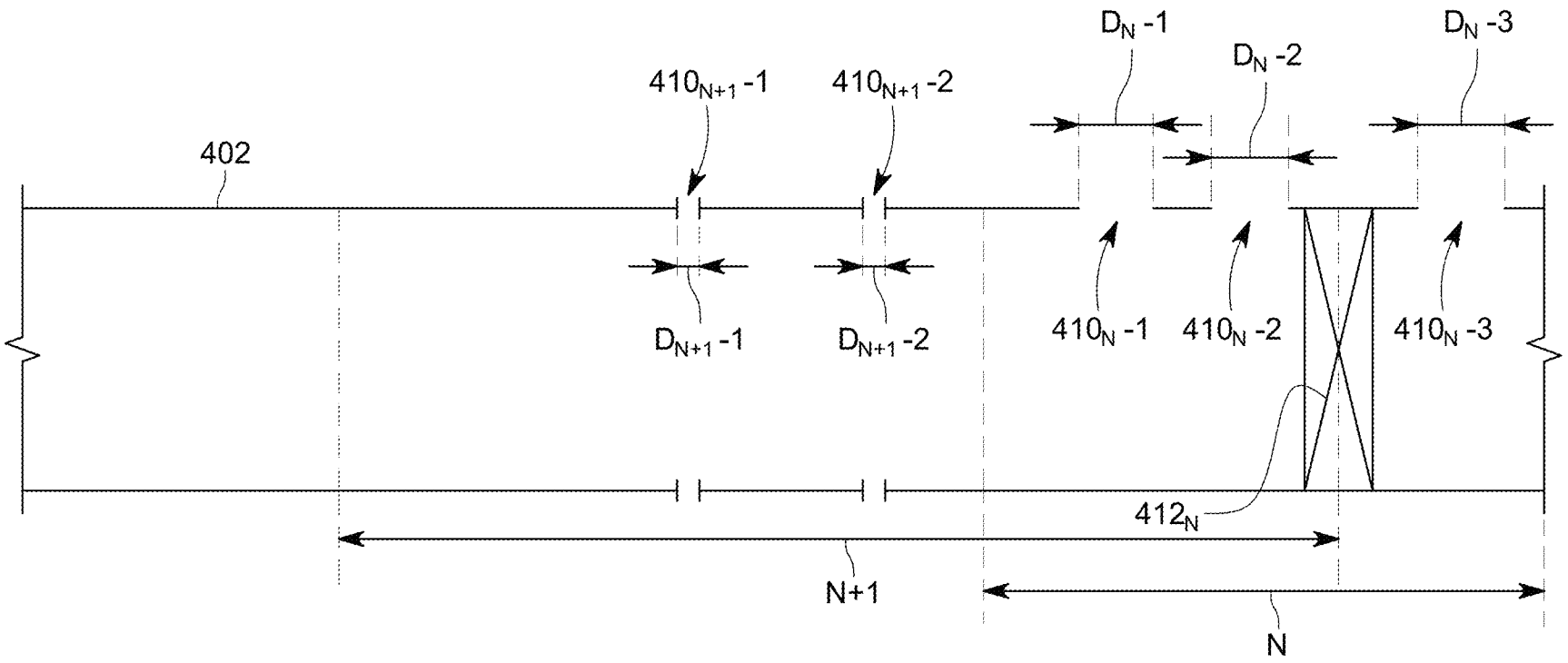

If the plug 412$_N$ is placed within the stage N, as shown in FIG. 5B, and new perforation clusters 410$_{N+1}$-1 and 410$_{N+1}$-2 (generically referred to as 410$_{N+1}$-I) are made in the stage N+1, these new clusters will have a diameter $D_{N+1}$-1 and $D_{N+1}$-2, which are typically smaller than the diameters $D_N$-1 and $D_N$-2 of the holes in the stage N. After the new stage N+1 is fractured, due to the fluid erosion, the diameters $D_N$-1 and $D_N$-2 of the holes in the stage N are enlarged, to be similar to the diameter $D_N$-3 of the perforation cluster 410$_N$-3, as illustrated in FIG. 5C. In this way, when overlap stages are implemented, the heel-ward perforation clusters 410$_N$-1, 410$_N$-2 of a previous stage N are enlarged during the fracturing of the next stage N+1, to have a similar diameter as the toe-ward perforation clusters 410$_N$-3 of the previous stage N.

However, it is possible that after setting the plug 412$_N$ within the stage N, and sealing off a first subset 416$_N$-1 of perforation clusters and leaving exposed to fluid communication with the fluid within the bore a second subset 416$_N$-2 of perforation clusters, as shown in FIG. 5B, only the second subset 416$_N$-2 is perforated again as part of the new stage N+1. It is also possible that no new perforation clusters are formed in the new stage N+1, so that the new stage N+1 includes only the perforation clusters from the second subset 416$_N$-2. However, it is also possible that any number of new perforation clusters 410$_{N+1}$-I is added to the new cluster N+1. The number of perforation clusters in each of the first and second subsets 416$_N$-1 and 416$_N$-2 can vary from 1 to the maximum number of perforation clusters minus 1. In one application, the second subset includes only one hole formed in the well casing.

Figure 6:
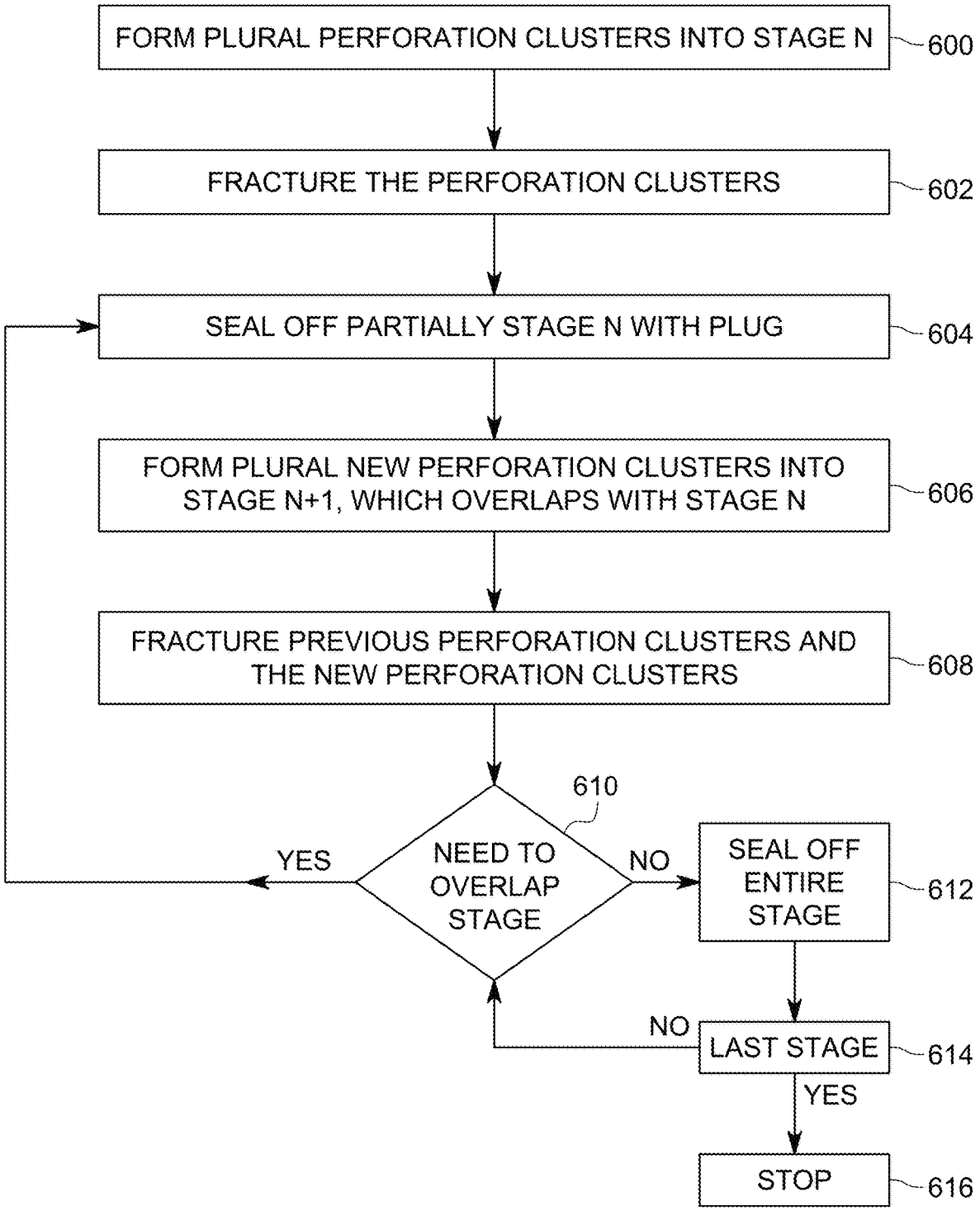
FIGS. 6-9 are flowcharts illustrating various methods for perf and frac operations with overlapped stages.

A method for enlarging the diameter of the heel-ward perforating clusters in a given stage N, while the diameter of the toe-ward perforating clusters are maintained unchanged is now discussed with regard to FIG. 6. In step 600, a gun 420 is lowered into a well casing 402 and plural perforation clusters 410$_N$-1 to 410$_N$-3 are made, which correspond to a stage N, where N is an integer larger than 1. In step 602, the gun is removed from the well casing and a proppant material is pumped (the stage is fractured), with a compressor from the surface, through the plural perforation clusters into the formation around the well casing, that corresponds to the stage N. As a consequence of this step, the diameter of the perforations of the toe-ward perforation clusters is likely larger than the diameter of the perforations of the heel-ward perforation clusters, as illustrated in FIG. 5B.

After the fracturing operation, in step 604, a corresponding plug 412$_N$ is setup in the well casing, to seal of a portion of the stage N, but not the entire stage N, as illustrated in FIG. 5B. Any known tool, for example, a setting tool, may be used for setting up the corresponding plug. At least one perforation cluster 410$_N$-1 associated with the smaller diameter perforations of the stage N is left upstream of the plug, as also shown in FIG. 5B. The setting up of the plug 412$_N$ determines the toe-ward end of the next stage, N+1, as shown in FIGS. 5B and 5C. In step 606, which is optional, a gun is lowered into the casing, at the new stage N+1, and detonated to form new perforation clusters 410$_{N+1}$-1 and 410$_{N+1}$-2. Any known plug and perf device may be used to form the new perforation clusters. One or more of these perforation clusters may be made in the part of the previous stage N that was not sealed or into the new stage N+1. In one embodiment, the new perforation clusters are made both into the previous stage N and the new stage N+1. In one application, no new perforation clusters are made in the current stage N+1. In this case, the current stage N+1 is only used for the frac operation, to enlarge the diameter of the perforation clusters from stage N that are present in stage N+1.

In step 608, part of the perforation clusters of the previous stage N and the perforation clusters of the new stage N+1 (if any is made) are simultaneously fractured with the proppant material, to increase a diameter of the perforation clusters of the previous stage N, as shown in FIG. 5C. In one application, only a subset of the perforation clusters of the previous stage N and all the perforation clusters of the current stage N+1 are fractured simultaneously. In step 610, a determination is made of whether the current stage needs to be fully sealed or only partially sealed. If the current stage N+1 needs to be partially sealed, the process returns to step 604. If the current stage needs to be fully sealed, the process advances to step 612 to set up a corresponding plug $\mathbf{412}_{N+1}$ to fully seal the stage N+1. In step 614 the process checks if the current stage N+1 was the last stage. If the answer is yes, the process stops at step 616, otherwise it returns to step 610. In this way any desired consecutive two stages N and N+1 can be overlapped with any desired number of perforation clusters.

Various additional steps may be added to this method. For example, in step 606, the newly added perforation clusters may be added only to the previous stage N, or only to the current stage N+1, or to both stages. Some of the newly added perforation clusters may be matched to the previous perforation clusters.

In one application, the plug is not a solid plug that fully seals the bore of the casing well, but the plug has a mandrel or similar internal structure that provides a fluid communication channel between the previous stage N and the current stage N+1. For example, the plug can be a retrievable ball in place plug that uses a ball for fully sealing the current stage N+1 from the previous stage N. The ball may be a degradable ball, or a ball on a string. The plug may also be a standing valve plug. In fact, any type of plug may be used with this method. If a plug having an interior bore is used, it allows an immediate step down rate testing into the newly isolated perforation clusters of the current N+1 stage, to determine if additional perforating clusters should be added, or how many should be added. In yet another variation, a test packer could be incorporated into the tool string, and combined with the previous testing, to determine where the plug should be placed inside the well casing.

Frac plugs typically have a through hole which enables flow past the plug without a ball on a seat, so that wireline tool strings can be pumped down with the plug (but not ball) in place. With this well design, solid plugs (bridge plugs) could be used with slightly more risk (because no flow back operations can be performed with solid plugs), but much less cost. These plugs could be composite, hybrid of metal and composite, degradable or partially degradable.

In another variation of the method discussed herein, the number of overlapped perforation clusters in the current stage N+1 can be varied from zero to a total number of the perforation clusters in the previous stage N minus one. The hole size distributions or number of holes in the perforation clusters can be varied in the various stages to promote a toe dominated treatment for the successive stages.

Not all the stages in the well need to be overlapped. The configuration of the frac process can be designed to "reset" to a full un-overlapped stage every 3, 4, or "M", stages, as the design parameters in step 606 may be successively changed. In other words, it is possible to have overlapped stages N, N+1, . . . , N+I, followed by traditional stages N+I+1, . . . N+I+J, followed by overlapped stages N+I+J+I, . . . N+I+J+K, where I, J, and K are any integers. Thus, in one embodiment, there is a mixture of conventional and overlapped stages, even without design parameters which would need to be reset. The needed to overlap stages could be determined by where the wireline string impacts sand in the well, which should occur at the perforations which took fluid and sand. In one application, overlapping stages could be targeted to specific portions of the well, based on well inclination, drilling plan, actual versus target depth, drilling correction zones, or geology. Thus, in this application, the selection of the locations where to have overlapped stages is based on one or more of these parameters.

The fracture treatment in the overlapped stages can be reduced or changed to control or limit (a) parent-child well interactions, (b) treating into natural fractures, (c) toe/heel dominance, while still maintaining fracture density. In this regard, note that the operator of the well could be aware of data, for example, seismic data that imagine the subsurface, that indicates various specific situations with regard to the well (e.g., natural fractures). For these situations, the operator of the well selects to make the overlapped stages and also to control what amount of treatment to apply to the overlapped stages to account for the existing data. For example, if there are natural fractures at the toe-ward part of a given stage, that stage may be overlapped for increasing the diameters of the heel-ward perforation clusters. Feedback from micro-seismic measurements, tracer or any other real time fracture imaging could be used to stop the fracture treatment of a stage, and trigger the next overlapping stage, limiting extensive fractures while preserving well fracture density. Feedback from pressure measurements that take place when the well is explored could be used in a similar way. Feedback from the step rate testing (flow versus pressure response) conducted after step 604 in the method could be used to determine whether new perforations need to be added. As a measure of economy, a treatment stage may be planned and executed in conjunction with each wireline run, no matter the outcome of placement or overlap achieved.

In one embodiment, the inter-stage plug acts as a positively set diverter, which is much more reliable compared to conventional diversion products since its precise location is known, and testing and feedback can determine whether it is necessary and whether the amount of diversion needs to be reduced by adding additional perforations. For this reason, there will be a lower cost to create more stages in a well.

Due to this overlapping stage technology, there will be a stage by stage feedback for tuning the stage design in real time. The resultant fracture network will be less sensitive to heel-biased dominance, as each heel-dominant stage can be corrected as discussed above with regard to FIGS. 5A to 5C. A denser fracture network with a higher cluster treatment efficiency can be produced in such a well construct. Further, a balance can be achieved on the heel versus toe dominance in stages at a low cost.

Figure 7:
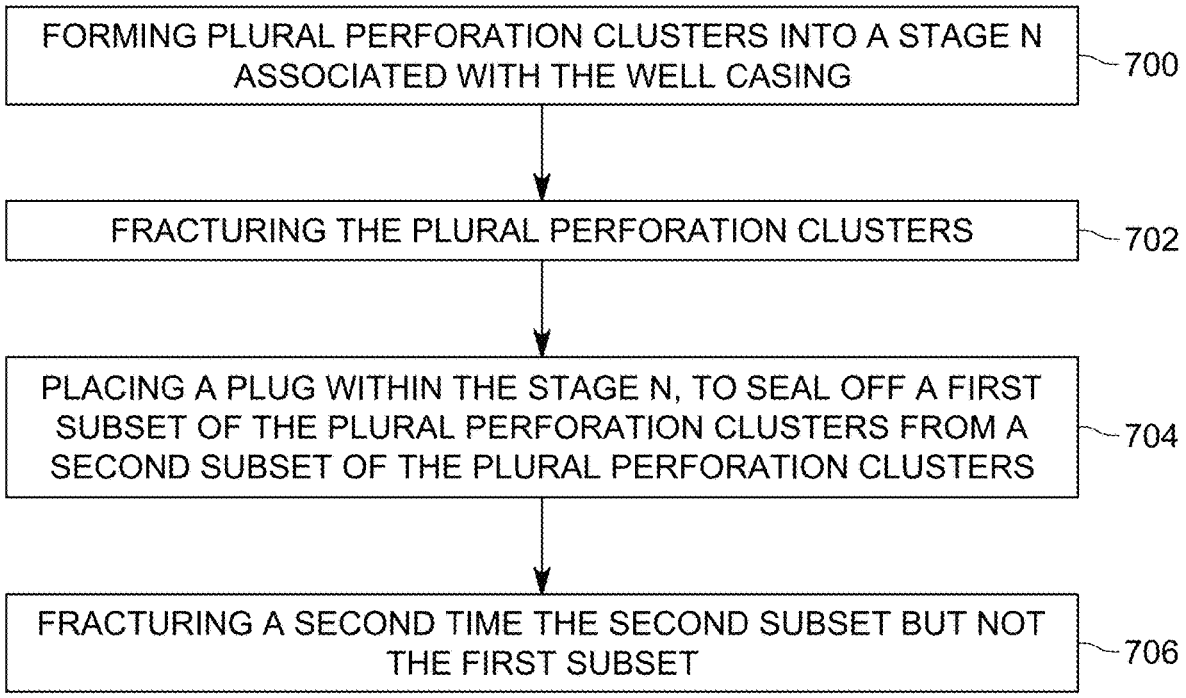

The novel technology discussed can be implemented in various ways in an actual well. A couple of those possibilities are now discussed. According to an embodiment, which is illustrated in FIG. 7, a method for fracturing a well casing 402 includes a step 700 of forming plural perforation clusters $\mathbf{410}_N$-I into a stage N associated with the well casing 402, a step 702 of fracturing the plural perforation clusters $\mathbf{410}_N$-I, a step 704 of placing a plug $\mathbf{412}_N$ within the stage N, to seal off a first subset $\mathbf{416}_N$-I of the plural perforation clusters $\mathbf{410}_N$-I from a second subset $\mathbf{416}_N$-2 of the plural perforation clusters $\mathbf{410}_N$-I, and a step 706 of fracturing a second time the second subset $\mathbf{416}_N$-2 but not the first subset $\mathbf{416}_N$-1.

The method may further include a step of forming plural perforation clusters $\mathbf{410}_{N+1}$-I into a current stage N+1 associated with the well casing 402, where the current stage N+1 is partially overlapped with the stage N. In one application, the current stage N+1 and the stage N share the second subset $\mathbf{416}_N$-2 of the plural perforation clusters $\mathbf{410}_N$-I.

The method may further include a step of fracturing simultaneously the plural perforation clusters $410_{N+1}$-I of the current stage N+1 and the plural perforation clusters $410_N$-I of the stage N. An overlap of the stage N and the current stage N+1 is defined by the second subset of the perforation clusters. In one application, one of the perforation clusters formed in the current stage N+1 is made to match a corresponding one of the perforation clusters formed in the stage N. In this application or another application, one of the perforation clusters formed in the current stage N+1 is made between two perforation clusters formed in the stage N. In this application or another application, a perforation cluster in the stage N or the current stage N+1 includes plural holes formed through the well casing to fluidly communicate a bore of the well casing with an exterior of the well casing.

In one embodiment, the step of fracturing a second time the second subset of the perforation clusters of the stage N increases a diameter of holes in the well associated with the perforation clusters. In this embodiment or another embodiment, the step of forming the plural perforation clusters in stage N includes lowering a gun into the well casing and detonated shaped charges of the gun to make holes through the well casing. In one application, the second subset $416_N$-2 includes one perforation cluster. In this or another application, the second subset $416_N$-2 includes one hole made in the well casing.

Figure 8:
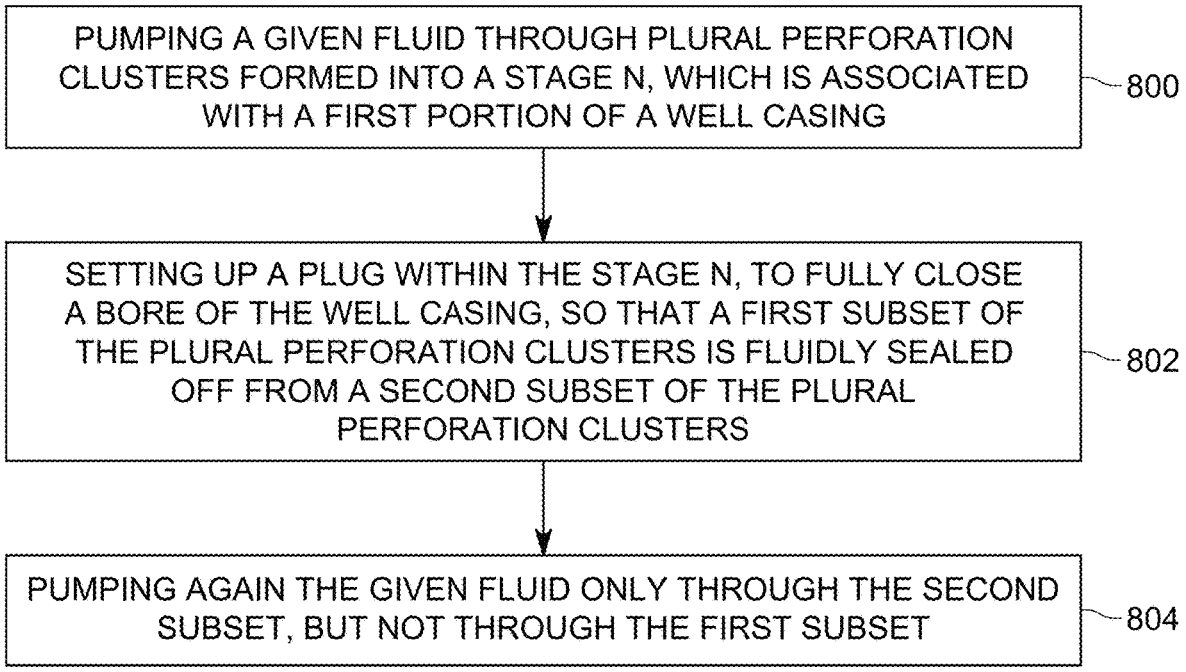

In another embodiment, as illustrated in FIG. 8, there is another method for fracturing a well and the method includes a step 800 of pumping a given fluid through plural perforation clusters $410_N$-I formed into a stage N, which is associated with a first portion of a well casing 402, a step 802 of setting up a plug $412_N$ within the stage N, to fully close a bore of the well casing 402, so that a first subset $416_N$-1 of the plural perforation clusters $410_N$-I is fluidly sealed off from a second subset $416_N$-2 of the plural perforation clusters $410_N$-I, and a step 804 of pumping again the given fluid only through the second subset $416_N$-2, but not through the first subset $416_N$-1.

The plug defines a toe-ward end of a current stage N+1 and the current stage N+1 is associated with a second portion of the well casing and the second portion overlaps with the first portion of the well casing. In one application, the second subset $416_N$-2 of the plural perforation clusters $410_N$-I is located in an overlap portion of the first and second portions of the well casing.

The method may further include a step of forming additional plural perforation clusters $410_{N+1}$-I into the current stage N+1, in a part of the second portion that is not overlapped with the first portion, and/or a step of simultaneously pumping the given fluid into the second subset $416_N$-2 of the plural perforation clusters $410_N$-I and the additional plural perforation clusters $410_{N+1}$-I of the current stage N+1. The method may further include a step of setting up another plug $412_{N+1}$ at an upstream end of the current stage N+1, to fully close the bore of the well casing 402, so that all the plural perforation clusters $410_{N+1}$-I of the current stage N+1 are fluidly sealed off, a step of forming new plural perforation clusters into a new stage N+2, in a third portion of the well casing, which does not overlap with the second portion, and a step of pumping the given fluid through the new plural perforation clusters of the new stage N+2.

Figure 9:
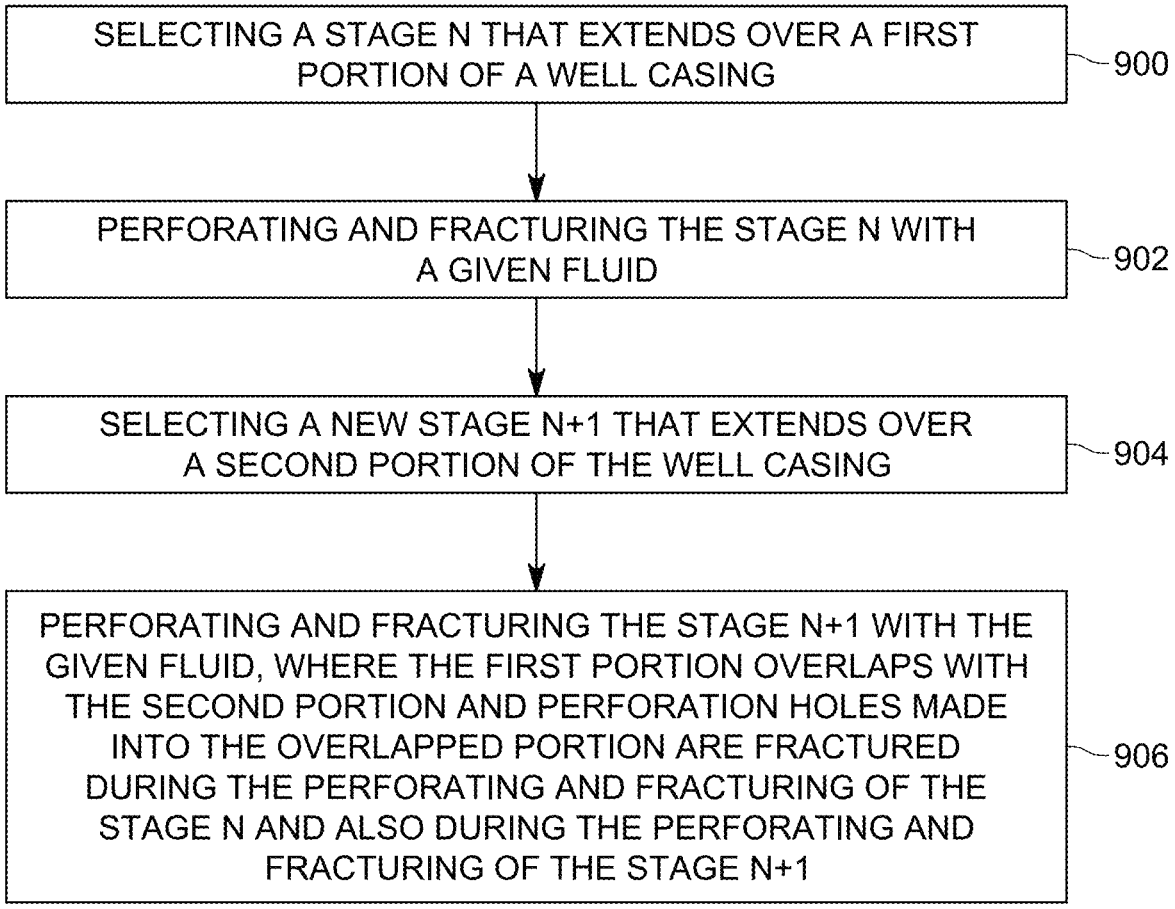

In yet another embodiment, as illustrated in FIG. 9, there is a method for fracturing a well, and the method includes a step 900 of selecting a stage N that extends over a first portion of a well casing, a step 902 of perforating and fracturing the stage N with a given fluid, a step 904 of selecting a new stage N+1 that extends over a second portion of the well casing, and a step 906 of perforating and fracturing the stage N+1 with the given fluid, where the first portion overlaps with the second portion and perforation holes made into the overlapped portion are fractured during the perforating and fracturing of the stage N and also during the perforating and fracturing of the stage N+1.

The disclosed embodiments provide a novel way to fracture plural stages in a well casing so that corrective action can be taken after a previous stage N has been fractured. With this technology, it is possible to fracture twice selected perforation clusters of a given stage, the first time when the given stage is fractured, and the second time when the next stage is fractured. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for fracturing a well casing, the method comprising:

forming plural perforation clusters into a stage N associated with the well casing, wherein the plural perforation clusters are made of a first subset of perforations and a second subset of perforations;

fracturing all the plural perforation clusters;

forming a current stage N+1 by placing a plug within the stage N, wherein the plug seals a first section of the well casing from a second section of the well casing to fluidly isolate the first subset of the plural perforation clusters from the second subset of the plural perforation clusters; and fracturing a second time all perforations of the second subset, but not the first subset as the first subset is fluidly isolated by the plug.

2. The method of claim 1, further comprising:

forming plural perforation clusters into the current stage N+1 associated with the well casing, wherein the current stage N+1 is partially overlapped with the stage N.

3. The method of claim 2, wherein the current stage N+1 and the stage N share the second subset of the plural perforation clusters.

4. The method of claim 3, further comprising:

fracturing simultaneously the plural perforation clusters of the current stage N+1 and the second subset of the plural perforation clusters of the stage N.

5. The method of claim 1, wherein an overlap of the stage N and the current stage N+1 is defined by the second subset of the perforation clusters.

6. The method of claim 2, wherein one of the perforation clusters formed in the current stage N+1 is made to match a corresponding one of the perforation clusters formed in the stage N.

7. The method of claim 2, wherein one of the perforation clusters formed in the current stage N+1 is made between two perforation clusters formed in the stage N.

8. The method of claim 1, wherein a perforation cluster in the stage N or the current stage N+1 includes plural holes formed through the well casing to fluidly communicate a bore of the well casing with an exterior of the well casing.

9. The method of claim 1, wherein the step of fracturing a second time the second subset of the perforation clusters of the stage N increases a diameter of holes in the well casing associated with the perforation clusters.

10. The method of claim 1, wherein the step of forming the plural perforation clusters in stage N includes lowering a gun into the well casing and detonating shaped charges of the gun to make holes through the well casing.

11. The method of claim 1, wherein the second subset includes one perforation cluster.

12. The method of claim 1, wherein the second subset includes one hole made in the well casing.

13. A method for fracturing a well, the method comprising:

pumping a given fluid through all plural perforation clusters formed into a stage N, which is associated with a first portion of a well casing, wherein the plural perforation clusters are made of a first subset of perforations and a second subset of perforations;

setting up a plug within the stage N, to close a first section of a bore of the well casing from a second section of the well casing, so that a first subset of the plural perforation clusters is fluidly sealed off from a second subset of the plural perforation clusters; and pumping again the given fluid only through all perforations of the second subset, but not through the first subset as the first subset is fluidly isolated by the plug from the second subset.

14. The method of claim 13, wherein the plug defines a toe-ward end of a current stage N+1.

15. The method of claim 14, wherein the current stage N+1 is associated with a second portion of the well casing and the second portion overlaps with the first portion of the well casing.

16. The method of claim 15, wherein the second subset of the plural perforation clusters is located in an overlap portion of the first and second portions of the well casing.

17. The method of claim 16, further comprising:

forming additional plural perforation clusters into the current stage N+1, in a part of the second portion that is not overlapped with the first portion.

18. The method of claim 17, further comprising:

simultaneously pumping the given fluid into the second subset of the plural perforation clusters and the additional plural perforation clusters of the current stage N+1.

19. The method of claim 13, further comprising:

setting up another plug at an upstream end of the current stage N+1, to close the bore of the well casing, so that all the plural perforation clusters of the current stage N+1 are fluidly sealed off;

forming new plural perforation clusters into a new stage N+2, in a third portion of the well casing, which does not overlap with the second portion; and pumping the given fluid through the new plural perforation clusters of the new stage N+2.

20. A method for fracturing a well, the method comprising:

selecting a stage N that extends over a first portion of a well casing;

perforating and fracturing the stage N so that all plural perforation clusters are fractured, wherein the plural perforation clusters are made of a first subset of perforations and a second subset of perforations;

selecting a new stage N+1 that extends over a second portion of the well casing; and perforating and fracturing the stage N+1 so that all perforations of the second subset of perforations are fractured, but none of the first subset, as the first subset of perforations is fluidly isolated by addition of a plug to the first portion of the well casing within the stage N, wherein the plug seals a first section of the first portion of the well casing from a second section of the first portion of the well casing, wherein the first portion overlaps with the second portion and the second set of perforation holes made into the overlapped portion are fractured with the given fluid during the perforating and fracturing of the stage N and also during the perforating and fracturing of the stage N+1.

* * * * *